US011992119B2

(12) United States Patent
Appelo et al.

(10) Patent No.: US 11,992,119 B2
(45) Date of Patent: May 28, 2024

(54) SHELF ASSEMBLY

(71) Applicant: MORGAN OLSON CORPORATION, Sturgis, MI (US)

(72) Inventors: Per-Erik Appelo, Knoxville, TN (US); Seth Wright, Loudon, TN (US)

(73) Assignee: Morgan Olson Corporation, Sturgis, MI (US)

( * ) Notice: Subject to any disclaimer, the term of this patent is extended or adjusted under 35 U.S.C. 154(b) by 371 days.

(21) Appl. No.: 17/076,232

(22) Filed: Oct. 21, 2020

(65) Prior Publication Data

US 2021/0112974 A1 Apr. 22, 2021

Related U.S. Application Data

(60) Provisional application No. 62/924,504, filed on Oct. 22, 2019.

(51) Int. Cl.
*A47B 43/00* (2006.01)
*A47B 96/07* (2006.01)

(52) U.S. Cl.
CPC ..... *A47B 43/00* (2013.01); *A47B 96/07* (2013.01)

(58) Field of Classification Search
CPC ..... A47B 43/00; A47B 46/005; A47B 96/07; A47B 96/061; A47B 96/021; A47B 57/42; A47B 57/46; A47B 57/52; A47B 57/045
See application file for complete search history.

(56) References Cited

U.S. PATENT DOCUMENTS 1,259,532 A * 3/1918 Leach ..... A47B 61/00 108/29
2,199,981 A * 5/1940 Bell ..... A47B 5/04 108/166
5,779,094 A * 7/1998 Stingel, Jr. ..... B65G 1/08 221/75
6,082,690 A * 7/2000 Durin ..... H02G 3/263 211/90.01
7,337,730 B2 * 3/2008 Bienick ..... F25D 25/02 108/108
7,757,615 B2 * 7/2010 McDonald, II ..... A47B 46/005 108/108
7,963,383 B2 * 6/2011 Stingel, III ..... B65G 1/026 414/331.04
8,985,344 B2 * 3/2015 Larson ..... B62H 3/12 211/1.51
9,526,355 B1 * 12/2016 Rollins ..... A47F 5/0056
9,801,465 B1 * 10/2017 Finch, Jr. ..... A47B 53/00
9,878,649 B2 * 1/2018 Beere ..... B60P 3/007
10,058,171 B2 * 8/2018 Deng ..... A47B 96/021
(Continued)

*Primary Examiner* — Patrick D Hawn
(74) *Attorney, Agent, or Firm* — Ballard Spahr LLP

(57) ABSTRACT

A shelf assembly can comprise a plurality of stanchions, each stanchion having an axis of elongation and comprising a pair of generally parallel legs that define a slot therebetween and respective front edges. A shelf can have an underside and an opposed upper surface that defines a plane. The shelf can be pivotably coupled to the stanchions about an axis about and between a stowed position and a use position. The axis can extend through the plurality of stanchions at a location above the plane when the shelf is in the use position. At least one biasing element can be disposed at least partially within the slot and configured to bias the shelf toward the stowed position.

20 Claims, 12 Drawing Sheets

(56) References Cited

U.S. PATENT DOCUMENTS

| | | | | |
|---|---|---|---|---|
| 10,149,535 | B2 * | 12/2018 | O'Keefe | F16M 13/02 |
| 10,258,152 | B1 * | 4/2019 | Lentine | A47B 96/066 |
| 10,470,565 | B1 * | 11/2019 | Levi | A47F 5/103 |
| 10,779,641 | B2 * | 9/2020 | Beere | A47B 96/07 |
| 11,208,048 | B2 * | 12/2021 | Herriman | B60R 5/04 |
| 11,470,961 | B2 * | 10/2022 | Henry, Jr. | A47B 96/025 |
| 2001/0035114 | A1 * | 11/2001 | Ash | A47B 5/02 108/147 |
| 2003/0127482 | A1 * | 7/2003 | Gort | B60P 3/14 224/564 |
| 2007/0241072 | A1 * | 10/2007 | Bryant | A47B 96/061 211/90.02 |
| 2019/0254422 | A1 * | 8/2019 | Beere | A47B 96/07 |
| 2021/0153645 | A1 * | 5/2021 | Beere | B60N 3/002 |

* cited by examiner

SHELF ASSEMBLY

CROSS-REFERENCE TO RELATED APPLICATIONS

The application claims priority to and the benefit of U.S. Provisional Application No. 62/924,504, filed Oct. 22, 2019, the entirety of which is hereby incorporated herein by reference.

FIELD

The disclosure relates to shelving, and, in particular, to shelves that are movable from a stowed position to a use position.

BACKGROUND

Conventional foldable shelves pivotably attach to T-studs. Accordingly, in order for the shelf to pivot upward to a stowed position, the shelf includes slots to receive portions of the T-studs that extend beyond a plane defined by an upper surface of the shelf. These slots can weaken the integrity of the shelf and be otherwise undesirable. Moreover, in the stowed position, the upper ends of the slots necessarily engage distal ends of the T-studs, thereby preventing the shelf from reaching a completely stowed positon (e.g., wherein the plane defined by the upper surface of the shelf is parallel to the dimension of elongation of the T-studs).

Further, conventional studs have lift assist gas springs that are connected via complex brackets and hardware that include a large number of parts. There is a need for solutions that reduce the number of parts required to attach a gas spring to provide lift assistance.

Some conventional shelves can further lack structural integrity, while others implement costly features to enhance structural integrity. Accordingly, a sturdy, inexpensive alternative is desirable.

SUMMARY

Described herein, in various aspects, is a shelf assembly comprising a plurality of stanchions, each stanchion having an axis of elongation and comprising a pair of generally parallel legs that define a slot therebetween and respective front edges. A shelf can have an underside and an opposed upper surface that defines a plane. The shelf can be pivotably coupled to the stanchions about an axis. The shelf can be pivotable about and between a stowed position and a use position. The axis can extend through the plurality of stanchions at a location above the plane when the shelf is in the use position. The shelf assembly can further comprise at least one biasing element. Each biasing element of the at least one biasing element can be disposed at least partially within the slot of a respective stanchion and configured to bias the shelf toward the stowed position.

When in the stowed position, the plane can be generally parallel to the axes of elongation of the stanchions.

When in the stowed position, the upper surface of the shelf can be disposed against the front edges of the plurality of stanchions.

When the shelf assembly is in the use position, the axis can be vertically spaced from the plane by between about 0.5 inches and about 3.0 inches.

The shelf can have a distal edge. The distal edge can define a flange that extends at an obtuse angle from the plane and above the plane when the shelf is in the use position.

The flange can have a first end that intersects the upper surface of the shelf and an opposed second end. The second end can comprise a rolled edge.

The rolled edge of the flange can have a tear-shaped profile.

The shelf assembly can further comprise a plurality of support arms. Each support arm of the plurality of support arms can be pivotably attached to a respective stanchion of the plurality of stanchions about the axis. Each respective support arm can be coupled to the underside of the shelf. The shelf can be pivotably coupled to the plurality of stanchions via the plurality of support arms.

Each respective support arm can comprise a base wall and a pair of spaced parallel walls that extend perpendicularly the base wall.

The at least one biasing element can be pivotably coupled to, and extending between, a respective stanchion and a respective support arm.

The at least one biasing element can comprise one or more gas springs.

The shelf assembly can further comprise a pair of horizontal rails that extend perpendicularly to the axes of elongation of the stanchions. The horizontal rails can attach to opposing first and second ends of each stanchion.

The at least one biasing element can comprise a first rod eye at a first end of the biasing element and a second rod eye at a second end of the biasing element. The first rod eye can be disposed at least partially within the slot of said respective stanchion. The second rod eye can be disposed at least partially between the pair of spaced parallel walls of a respective support arm.

A first pin can extend through the first rod eye and the slot of a respective stanchion of the plurality of stanchions. A second pin can extend through the second rod eye and the pair of spaced parallel walls of a respective support arm.

The shelf can be a first shelf of a plurality of shelves. The plurality of shelves of the shelf assembly can further comprise a second shelf. The shelf can be pivotable about the axis or a second axis that is parallel to the axis.

The second shelf can be independently pivotable with respect to the first shelf

A vehicle can comprise a shelf assembly as disclosed herein.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE DRAWINGS

These and other features of the preferred embodiments of the invention will become more apparent in the detailed description in which reference is made to the appended drawings wherein.

DETAILED DESCRIPTION

Figure 1:
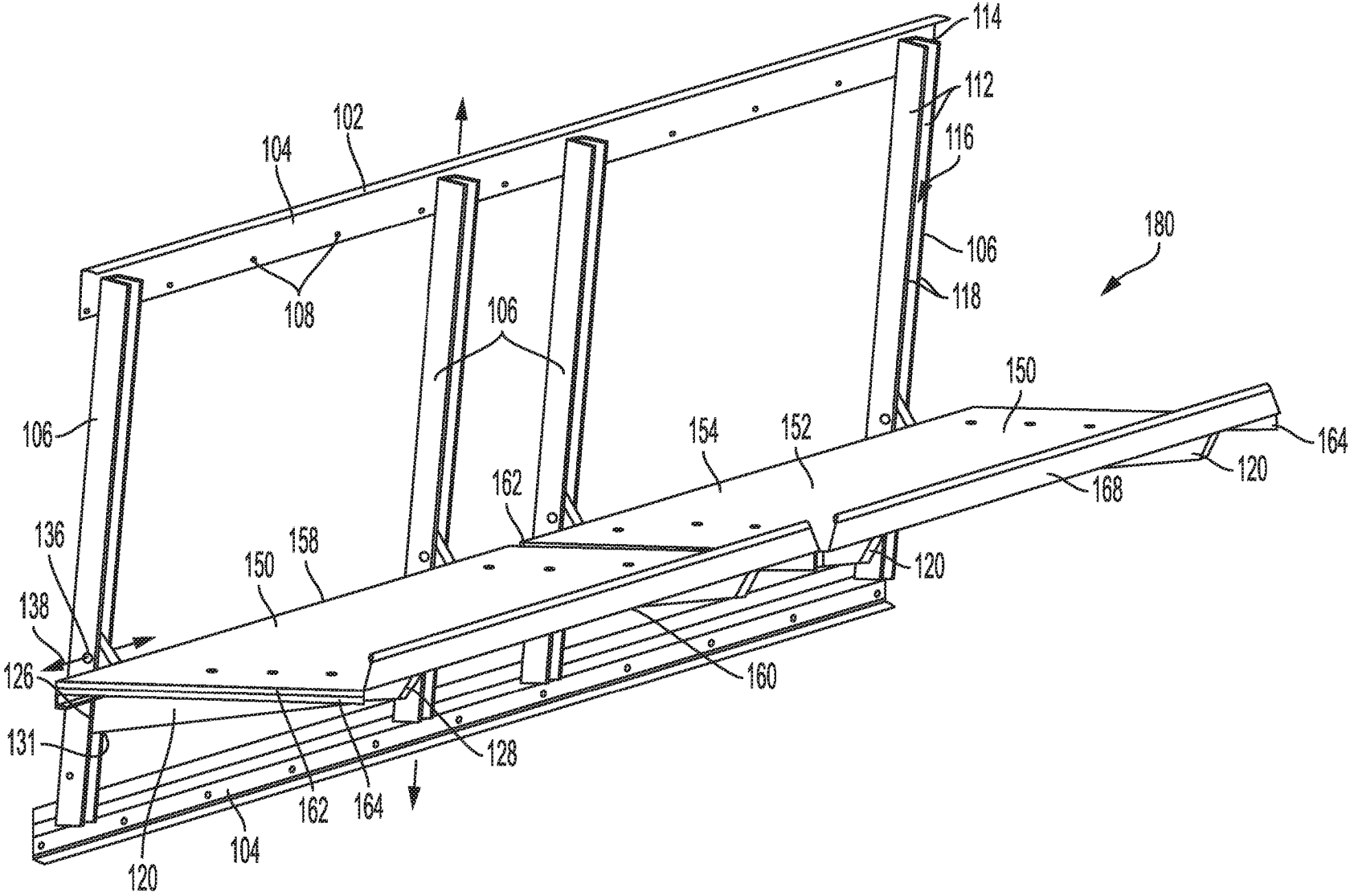
FIG. 1 is a perspective view of a shelf assembly, in accordance with embodiments disclosed herein, with the shelf assembly in a use position.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a," "an," and "the" include plural referents unless the context clearly dictates otherwise. For example, use of the term "a stanchion" can refer to one or more of such stanchions, and so forth.

All technical and scientific terms used herein have the same meaning as commonly understood to one of ordinary skill in the art to which this invention belongs unless clearly indicated otherwise.

As used herein, the terms "optional" or "optionally" mean that the subsequently described event or circumstance may or may not occur, and that the description includes instances where said event or circumstance occurs and instances where it does not.

As used herein, the term "at least one of" is intended to be synonymous with "one or more of" For example, "at least one of A, B and C" explicitly includes only A, only B, only C, and combinations of each.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 15%, up to 10%, up to 5%, or up to 1% (above or below) of the particularly stated value can be included within the scope of those aspects. Similarly, use of "substantially" (e.g., "substantially parallel") or "generally" (e.g., "generally planar") should be understood to include embodiments in which angles are within about ten degrees, or within five degrees, or within one degree.

The word "or" as used herein means any one member of a particular list and also includes any combination of members of that list.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

Disclosed herein, in various aspects and with reference to FIGS. 1-12, is a shelf assembly 100. The shelf assembly 100 can comprise a frame 102. The frame 102 can comprise a pair of horizontal (or substantially horizontal) rails 104 and a plurality of stanchions 106 attached to the horizontal rails 104 via fasteners (e.g., rivets). The rails 104 can comprise holes 108 for attaching the frame 102 to a mounting surface (e.g., an interior wall of a delivery truck or vehicle 107). Each of the rails 104 can have a respective profile that matches a mounting location on the mounting surface. In this way, the rails can match the contour of the mounting surface. The stanchions 106 can be elongate along an axis 110 (i.e., an "axis of elongation" or longitudinal axis). The stanchions 106 can have U-shaped profiles having a pair of parallel (or substantially parallel) legs 112 connected by a web 114. The stanchions can thus define a slot 116 between the parallel legs 112. Distal edges of the parallel legs 112 can define front edges 118.

As shown in FIGS. 1-5, a respective arm 120 can pivotably attach to each stanchion 106. Each arm 120 can be a fabricated sheet metal component. The arm 120 can comprise a base wall 122 and a pair of parallel (or substantially parallel) walls 124 extending perpendicularly or substantially perpendicularly to the base wall 122. The parallel walls 124 can be tapered (in length from the base wall) from a proximal end 126 of the arm 120 to a distal end 128 of the arm 120. Referring also to FIGS. 6-9, flanges 130 at the ends of the parallel walls 124 opposite the base wall 122 can cooperate to define an engagement surface for supporting a shelf 150.

Referring to FIGS. 1-3 and 10-12, proximal ends of the parallel walls 124 can define hinge portions 132 that extend beyond the flanges 130 (proximally of the flanges relative to the arms' respective longitudinal axes). The hinge portions 132 can be received within the slot 116. The hinge portions 132 can define coaxial through-holes 133 for receiving respective bushings 135. Similarly, stanchions 106 can define coaxial through-holes 139 for receiving respective bushings 135. A hinge pin 136 (i.e., a pin about which the arms 120 pivot with respect to the stanchions 106) can be pivotably received within the bushings 135. C-clips 137 can retain the hinge pin 136 axially in place. In this way, the arms 120 can be pivotable about a pivot axis 138 that extends through the stanchions 106. Top ends 134 of the hinge portions 132 can be rounded to allow the arms to pivot within the slot 116 without impacting the base wall 122. Accordingly, the arm can pivot freely without the top ends 134 of the hinge portions 132 interfering with the arm's range of motion. A stop 131 can attach to each arm 120 at a proximal end 126, where the base wall 122 meets the parallel walls 124. The stops 131 can engage the stanchions to stop pivoting of the shelf in a use position as further disclosed herein. Rear flanges 140 can extend from the proximal ends of the parallel walls 124 to provide support to the arm 120.

Referring to FIGS. 6-9, the shelf 150 can attach to the arms 120 via attachment hardware or fasteners, such as, for example, rivets 171. In some optional embodiments, the rivets 171 can be aluminum buck rivets. Referring to FIGS. 1-5, the shelf 150 can be fabricated from sheet metal. The shelf 150 can have an upper planar (or substantially planar) surface 152 that defines (or substantially defines) a top plane 154. The upper planar surface 152 of the shelf 150 can have a lower surface 156 that rests against flanges 130 of the arms 120. The shelf 150 can further have a proximal edge 158, a distal edge 160, and opposing side edges 162. The shelf 150 can comprise flanges 164 that extend downwardly (i.e., below the top plane 154 when the top plane is horizontal or substantially horizontal) or upwardly (i.e., above the top plane 154 when the top plane is horizontal or substantially horizontal) on each of the opposing side edges 162. The shelf 150 can further comprise a first proximal flange 166 that extends downwardly from the proximal edge 158 and a second proximal flange 167 that extends from an end of the first proximal flange 166 opposite the upper planar surface 152. The second proximal flange 167 can extend parallel or generally parallel to the upper planar surface 152 of the shelf 150. The shelf 150 can have a flange 168 that extends upwardly from the distal edge 160 and perpendicularly or generally perpendicularly to the top plane 154. The flange 168 can have a rolled end 170 opposite the upper planar surface 152. The rolled end 170 can define a teardrop shape. That is, the rolled end can comprise a rounded portion and a generally planar portion that extends back toward the distal edge 160. The flange 168 and, in particular, the teardrop shape can provide structural support to the shelf 150. In this way, the disclosed shelves can be formed from a lighter gauge sheet metal than is used to form conventional shelves, without additional reinforcement members attached, while still providing comparable rigidity. The shelf 150 can further define notches 172 that receive portions of arms 120.

According to various aspects, the shelf assembly 100 can comprise a plurality of independently pivotable shelves 150 (two shown). According to various aspects, the independently pivotable shelves can be arranged either in the same plane or at multiple levels (e.g., vertically offset). Each shelf 150 can be supported by two arms 120 that are pivotably attached to respective stanchions 106. In further embodiments, more than two arms 120 can support each shelf 150.

Figure 2:
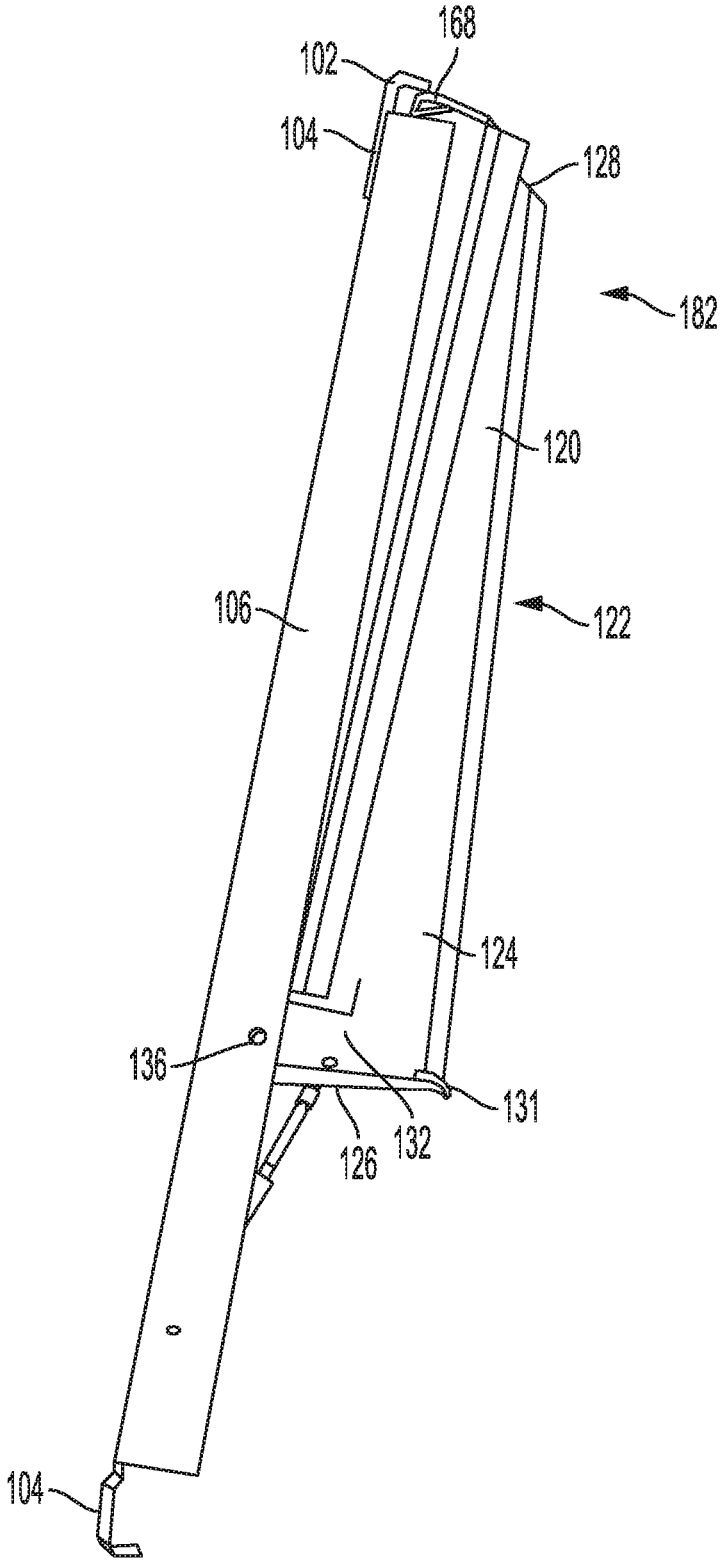
FIG. 2 is a side view of the shelf assembly as in FIG. 1, with the shelf assembly in a stowed configuration.
Figure 3:
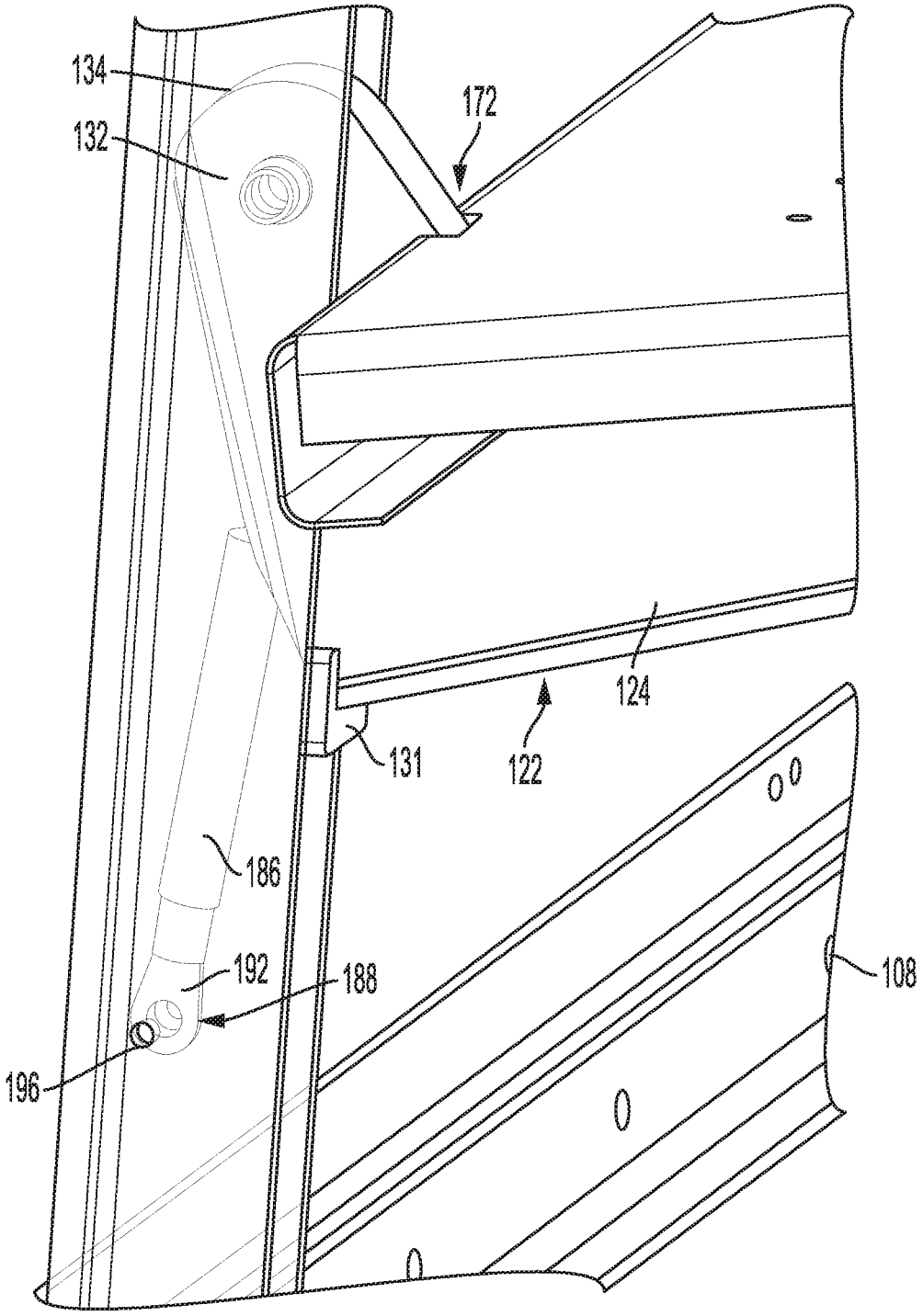
FIG. 3 is a close up perspective view of the shelf assembly as in FIG. 1, showing details of a hinge attachment and a gas spring.
Figure 4:
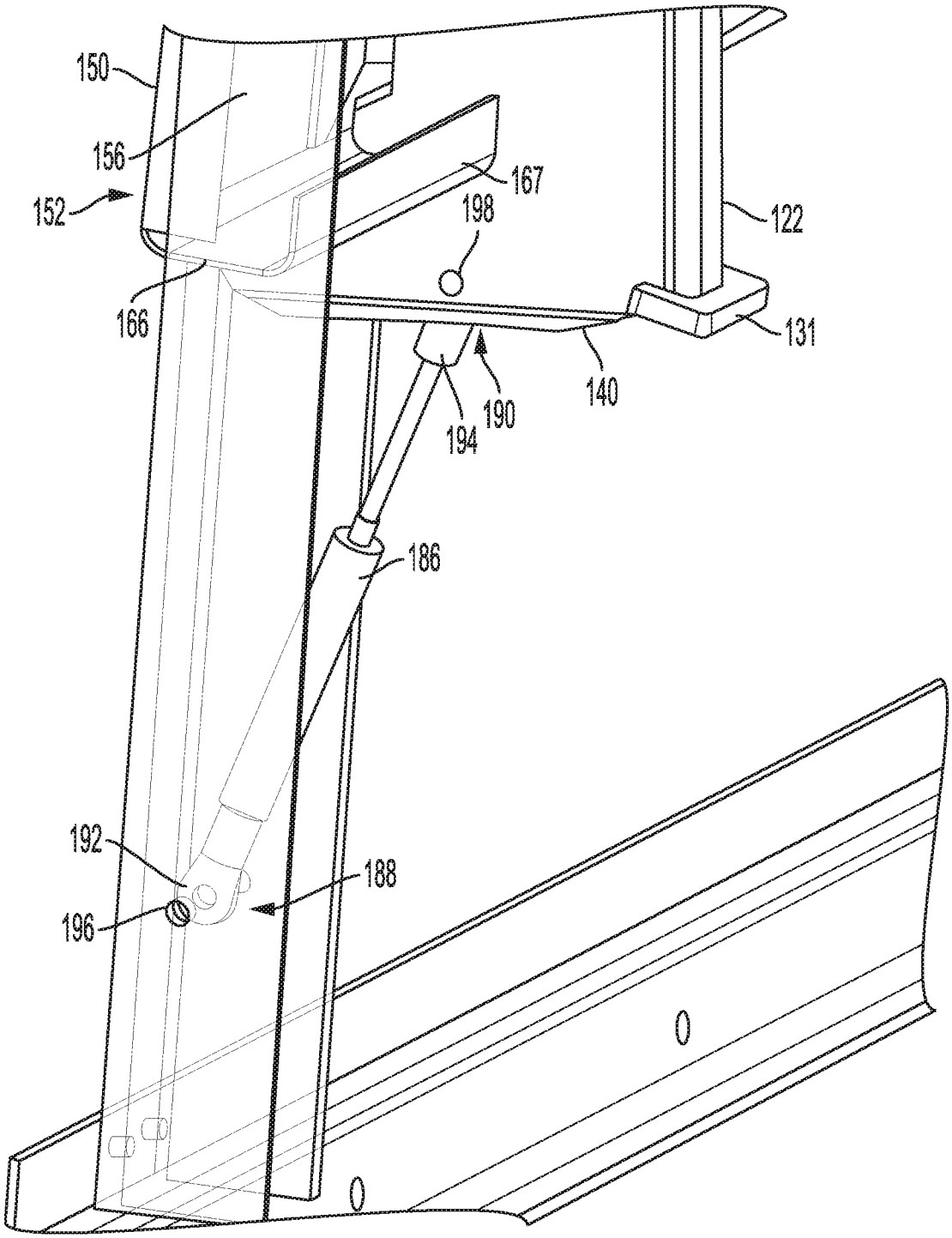
FIG. 4 is a close up perspective view of the shelf assembly as in FIG. 2, showing details of a hinge attachment and a gas spring.
Figure 5:
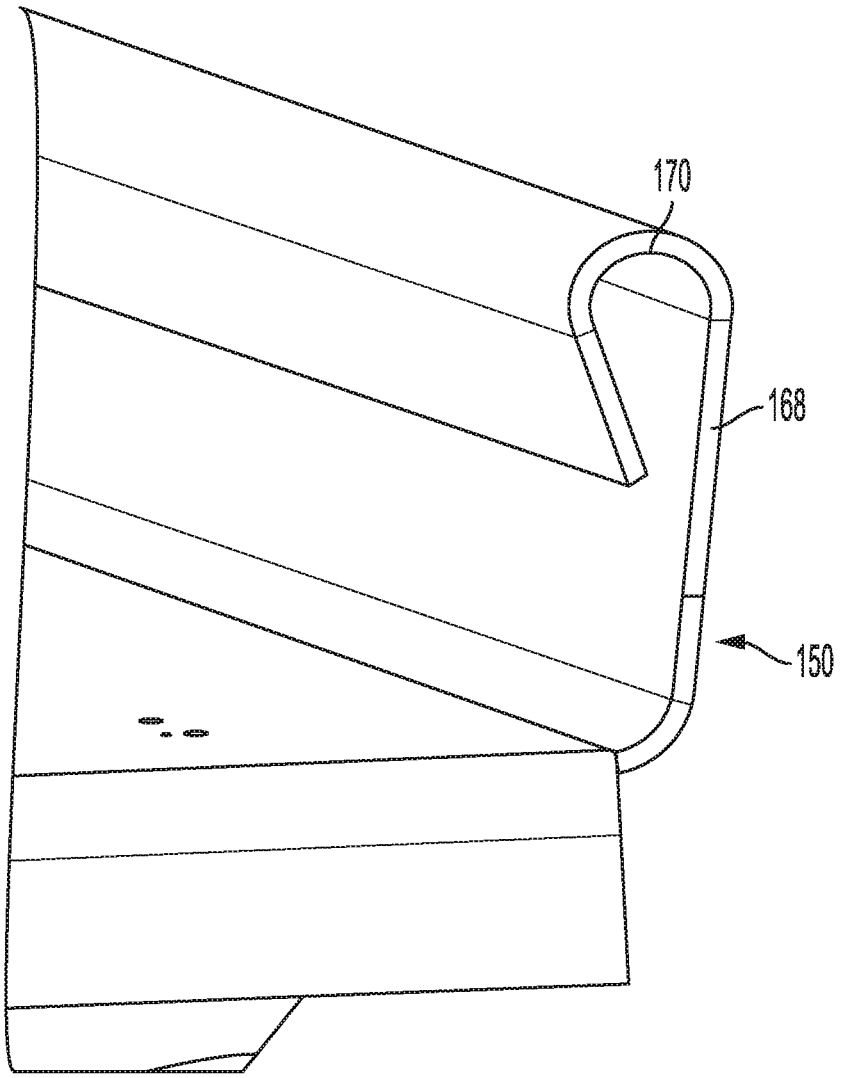
FIG. 5 is a close up perspective view of the shelf assembly as in FIG. 1, showing details of a distal flange on the shelf.
Figure 6:
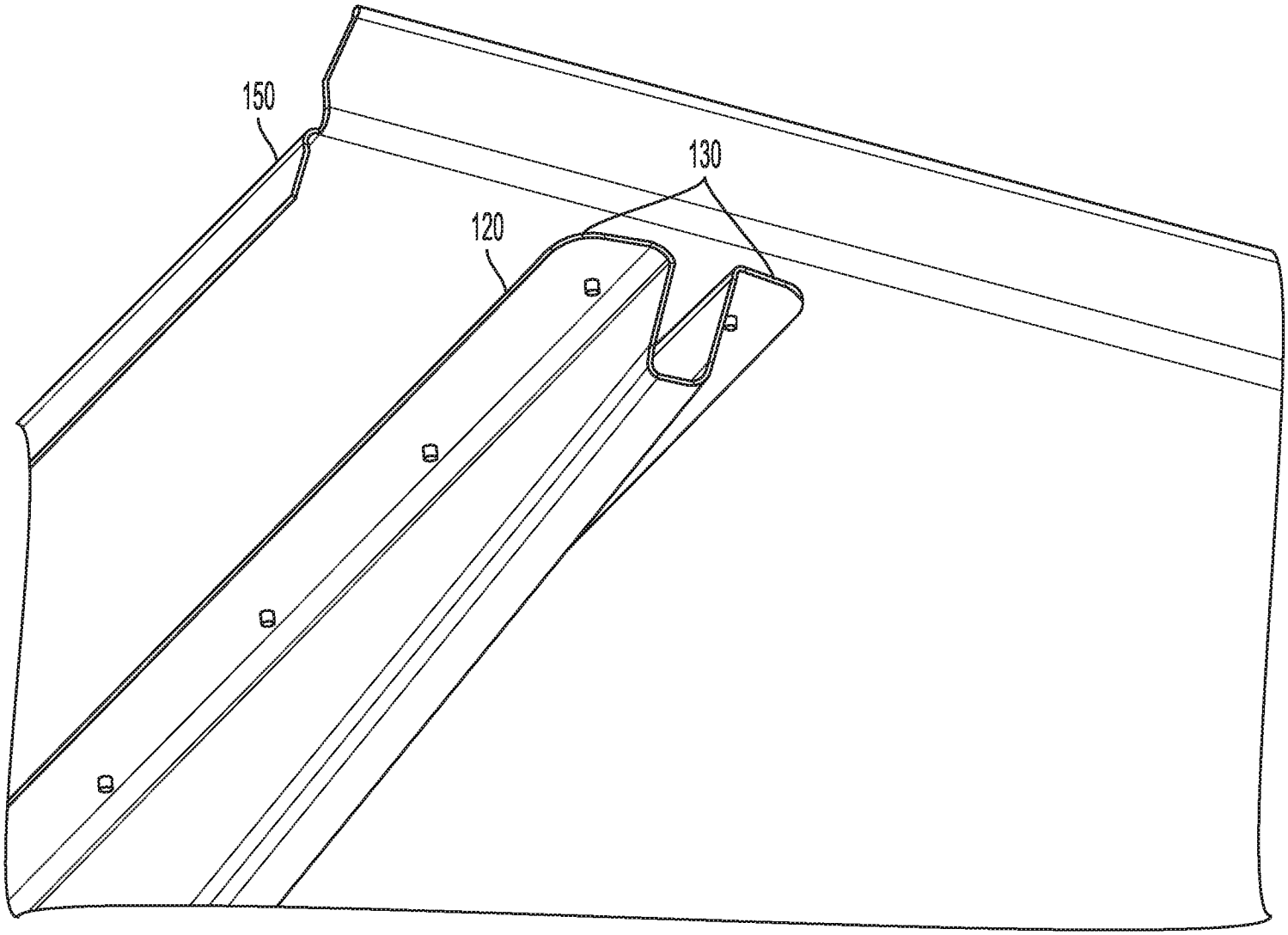
FIG. 6 is a partial underside view of the shelf assembly as in FIG. 1.
Figure 7:
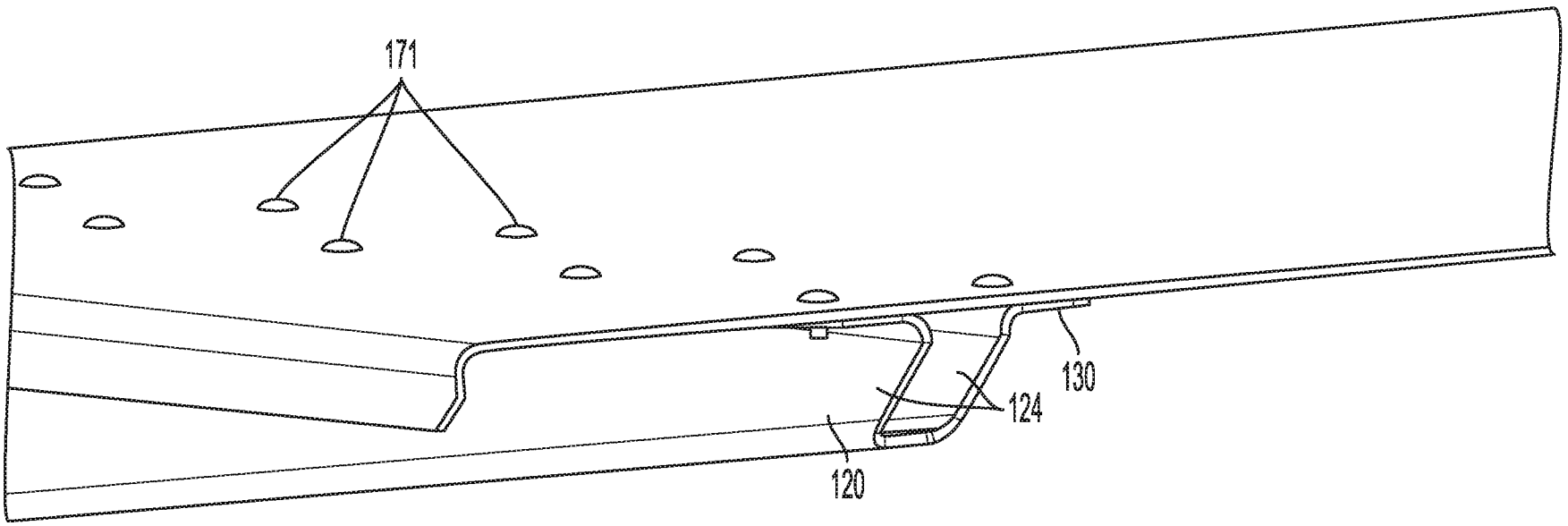
FIG. 7 is a partial corner view of the shelf assembly as in FIG. 1.
Figure 8:
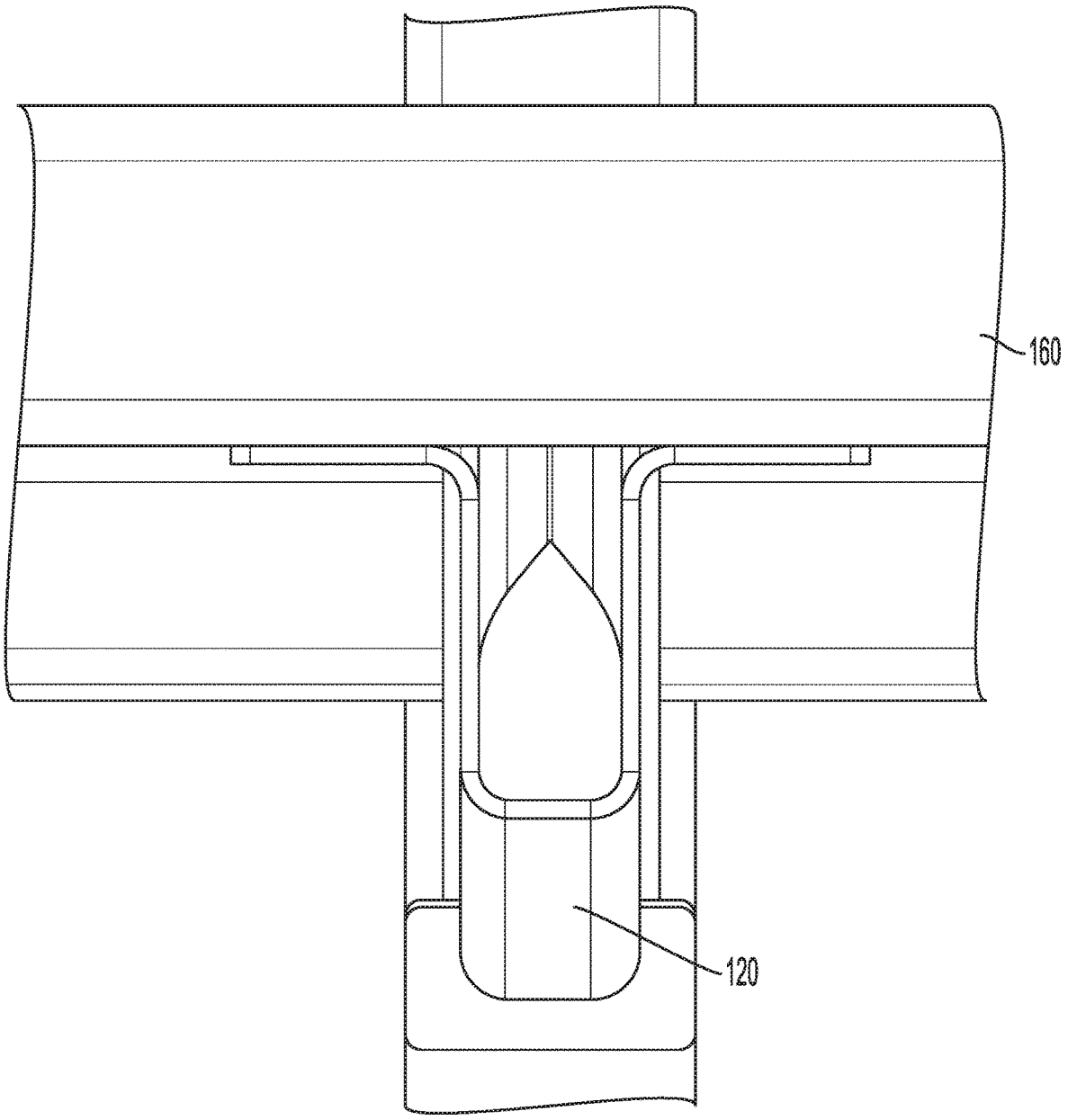
FIG. 8 is a partial front view of the shelf assembly as in FIG. 1, illustrating an abutment between an arm and a shelf
Figure 9:
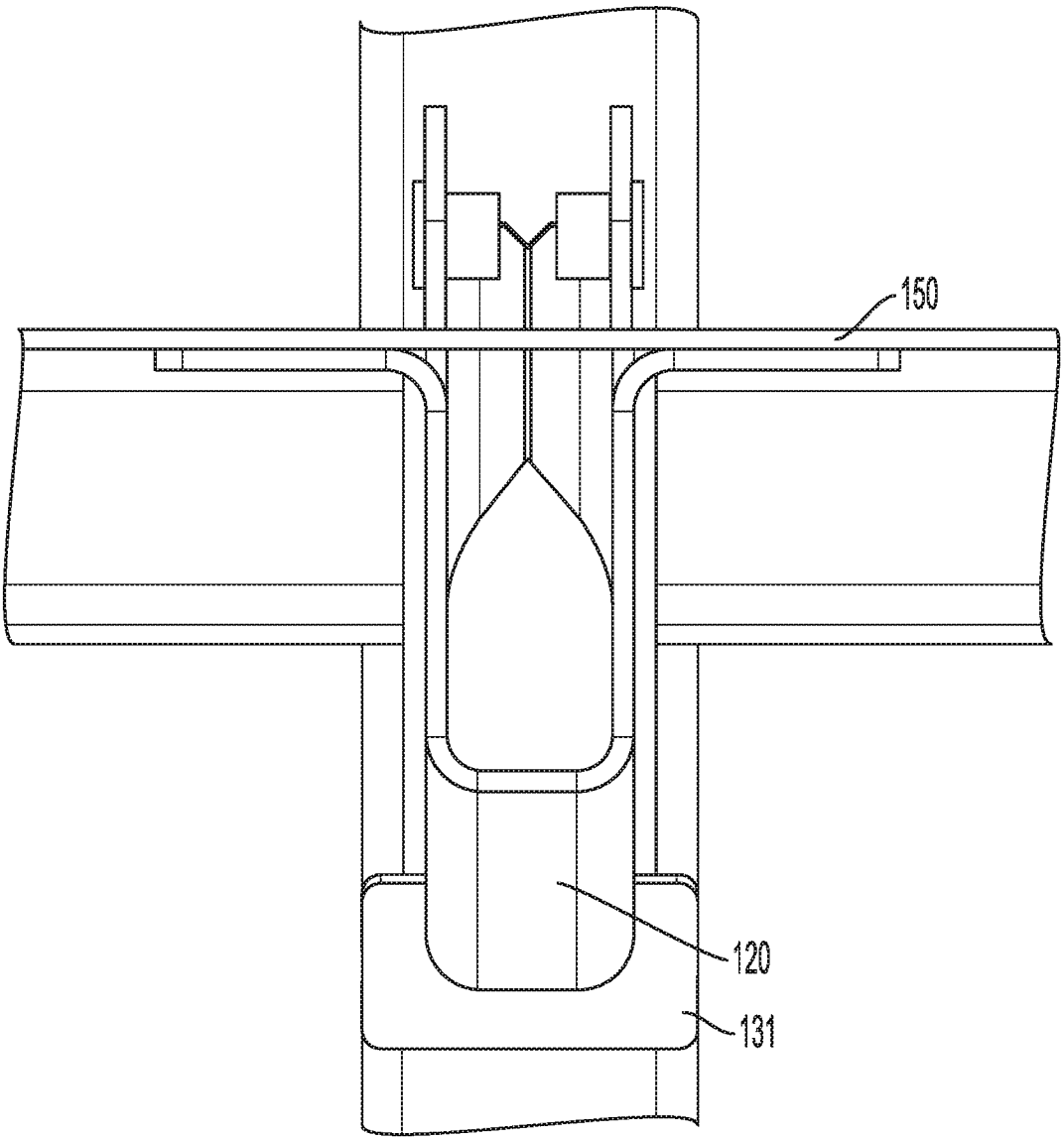
FIG. 9 is a partial cut-away view of the shelf assembly as in FIG. 1, illustrating an abutment between an arm and a shelf
Figure 10:
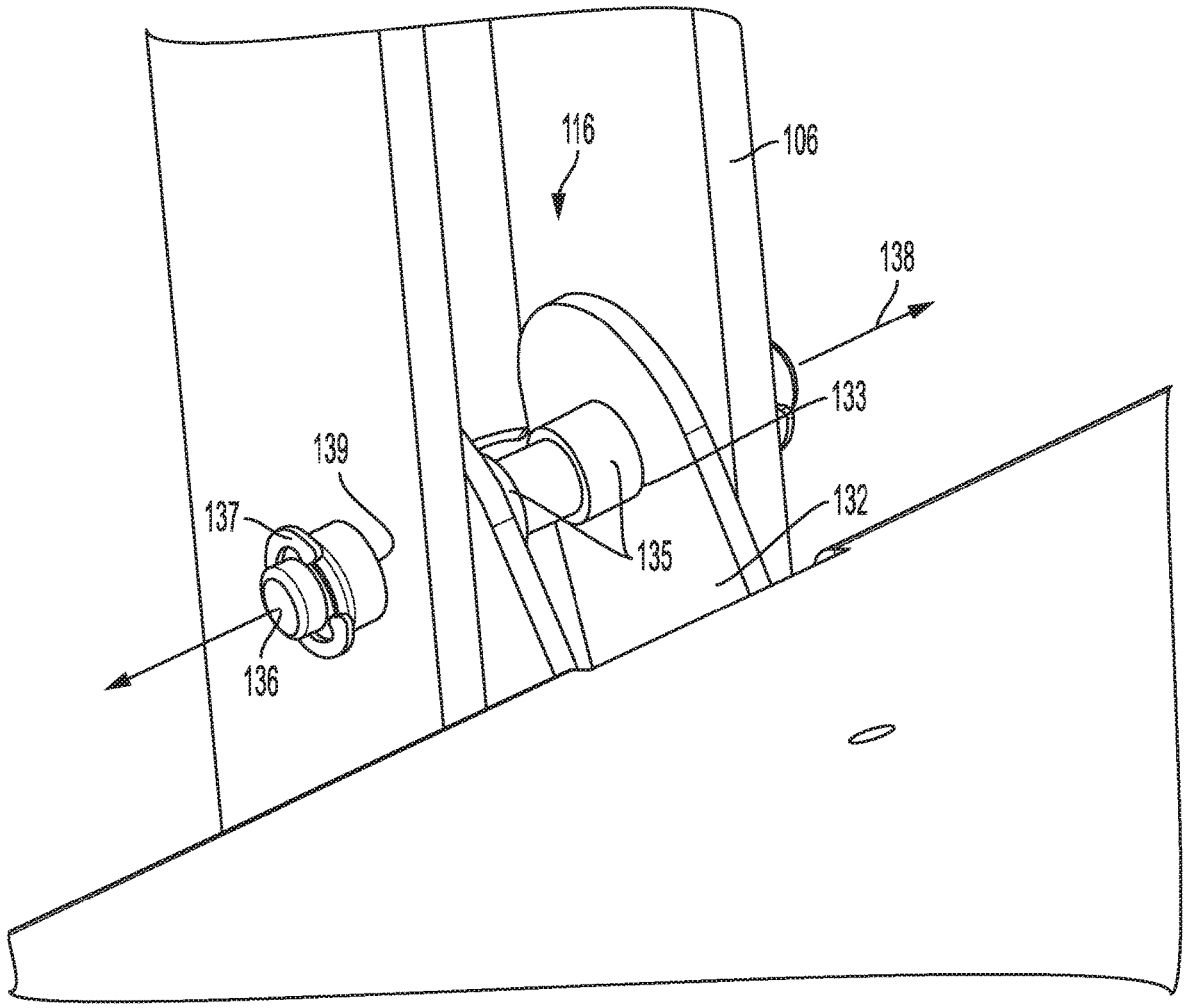
FIG. 10 is a partial perspective view of a pivot point between the shelf and a stanchion of the shelf assembly as in FIG. 1.

Each shelf 150 can be pivotable about and between a use position 180 (shown in FIG. 1) and a stowed position 182 (shown in FIG. 2). In the stowed position 182, the flange 168 can be positioned above top ends of the respective stanchions 106. That is, the shelf can have a sufficient width (dimension extending distally from the stanchions) so that the rolled end 170 extends above the top ends of the stanchions 106, thereby allowing for an optimally compact stowed configuration. As shown, the pivot axis 138 of the arms 120, and therefore, the shelf 150, can be spaced vertically above the top plane 154 when the shelf is in the use position 180. In some optional embodiments, the distance between the pivot axis 138 and the plane 154 can be between about 0.5 inches and about one inch, about one inch to about 1.5 inches, about 1.5 inches to about two inches, about two inches to about three inches, or greater than three inches. It is contemplated that this distance can be slightly greater than the distance between the axis 138 and the distal ends 118 of the stanchions 106 in a horizontal dimension that is perpendicular or substantially perpendicular to the axis 138 (e.g., by between 0 and 0.5 inches). In this way, when the shelf 150 is in the stowed position, the upper planar surface 152 can be parallel or substantially parallel to the axes of elongation 110 of the stanchions. In some embodiments, the shelf 150 can be raised so that the top plane 154 is past a parallel orientation. That is, the plane 154 and the axes 110 intersect at a position above the pivot axis 138. According to further aspects, when in the stowed position 182, the upper planar surface 152 of the shelf 150 can abut, or be substantially adjacent (for example, be within less than 0.25 inches of), the front edges 118.

Figure 11:
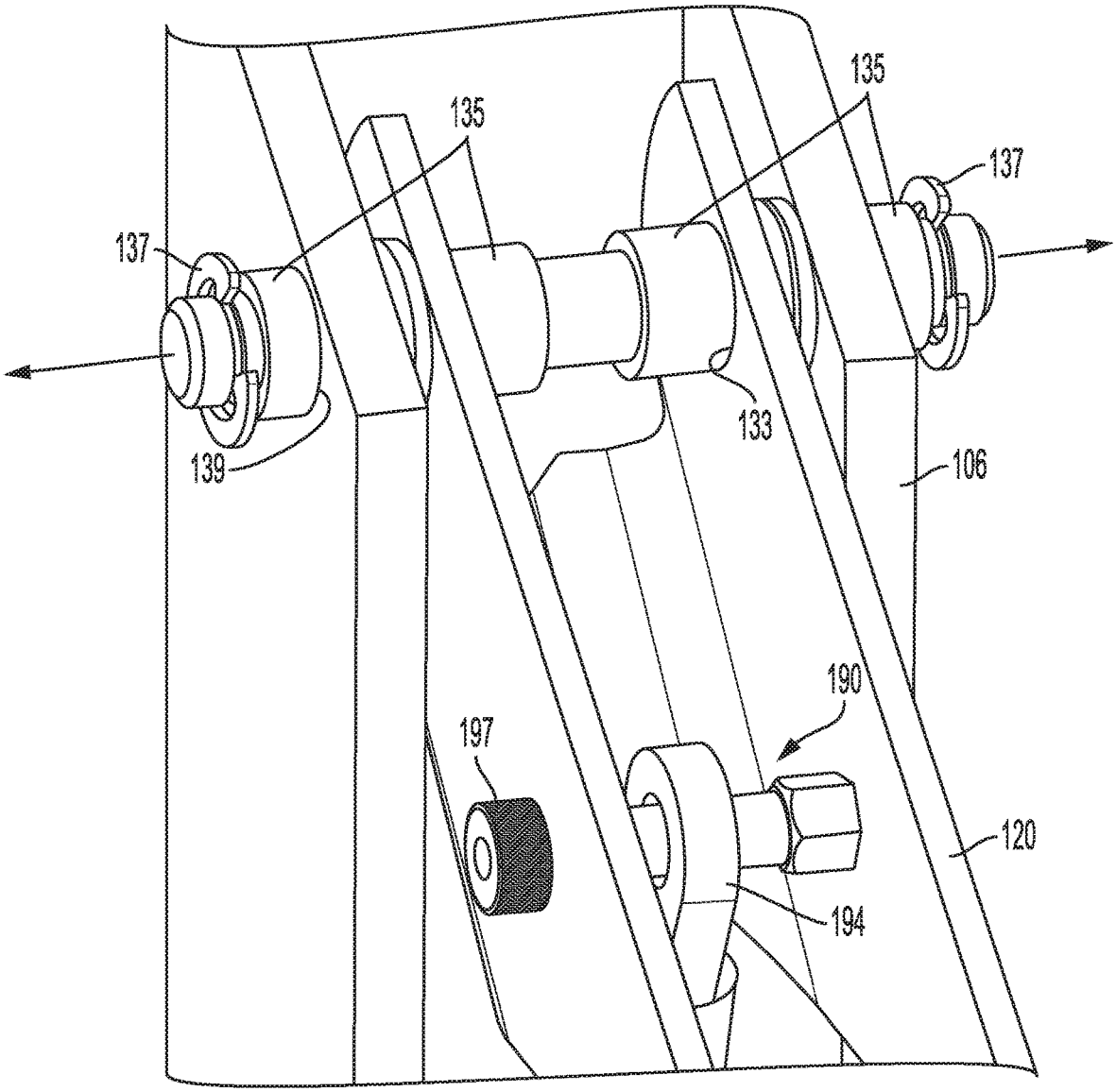
FIG. 11 is a cutaway partial perspective view of a pivot point between the arm and a gas spring.
Figure 12:
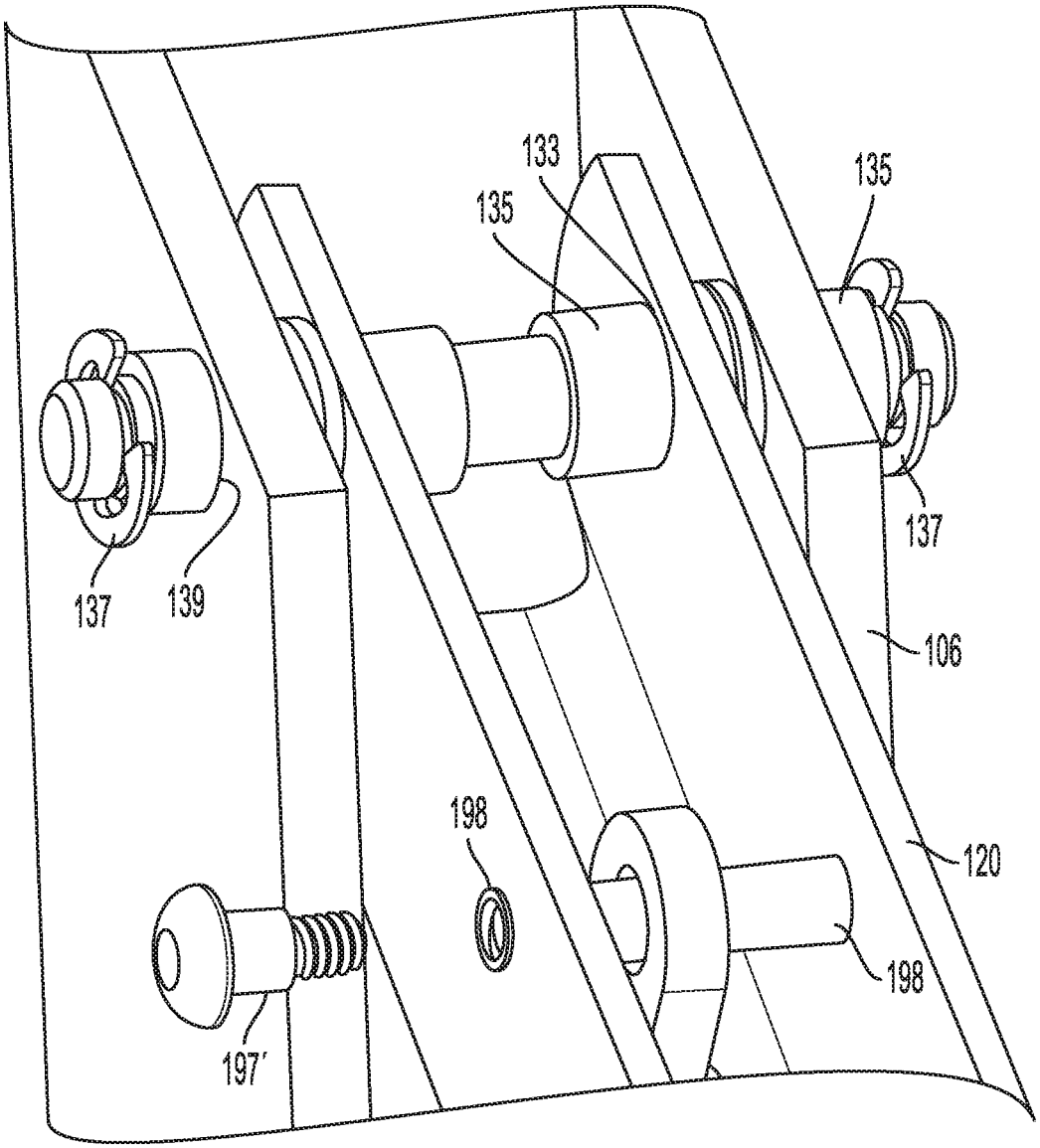
FIG. 12 is a cutaway partial perspective view of another embodiment pivot point between the arm and the gas spring.

A gas spring 186 (or other spring) can pivotably attach at a first end 188 to a stanchion 106 and at a second end 190 to the hinge portion 132 of an arm's parallel walls 124. The first end 188 of the gas spring 186 can comprise a first rod eye 192 (e.g., a rod having a transverse through hole therethrough at one end) that is receivable within the slot 116, and the second end 190 of the gas spring 186 can comprise a second rod eye 194 that is receivable between the hinge portions 132 of the arm's parallel walls. The stanchion 106 can define a pair of coaxial holes 196. A pin (e.g., a clevis pin or other pin, shown in FIGS. 11 and 12 and discussed below) can extend through the coaxial holes 196 and the first rod eye 192 to thereby couple the first end 188 of the gas spring 186 to the stanchion 106. Referring to FIG. 11, the arms 120 can define coaxial holes 198 in the hinge portions 132 of the parallel walls 124, and a pin 195 can extend through the coaxial holes and the second rod eye 194 to thereby couple the second end 190 of the gas spring 186 to the arm 120. A screw 197 (or a screw 197') can threadedly couple to female threads in the pin 105 so that the screw head provides a flange that axially retains the pin 195. As should be apparent to a person of skill in the art, various other pins (e.g., clevis pins, shoulder bolts and nuts, etc.) can be substituted for the pins illustrated herein. Thus, the stanchion 106 and arm 120 can serve as devises for connecting to the gas spring 186. In this way, attachment hardware for attaching the gas spring 186 between the frame 102 and the arm 120 can be minimized. Further, the gas spring 186 can be at least partially disposed within the slot 116. The second end 190 of the gas spring 186 can be positioned along the length of the shelf arm 120 so that, in combination with the spring force, the gas spring 186 applies a torque to the arm about the pivot axis 138 that is sufficient to hold the torque due to the weight of the shelf in the stowed position 182, yet the gas spring 186 applies a torque that is less than the torque due to the weight of the shelf when the shelf is in the use position 180. In this way, the gas spring can retain the shelf in the stowed position while allowing the shelf to stay in the use position under its own weight.

The gas spring 186 can provide a torque about the pivot axis 138 to bias the shelf 150 to the stowed position 182. The gas spring 186 can further dampen movement of the shelf 150. In some embodiments, the shelf assembly 100 can have a single gas spring 186 that provides torque to each shelf In further embodiments, the shelf assembly 100 can comprise a gas spring 186 at each end of each shelf 150, or at each stanchion 106. That is, in some embodiments having three or more stanchions 106 pivotably coupled to respective arms 120, and a gas spring 186 can attach between each stanchion 106 and the respective arm 120. In further embodiments, various other biasing elements and/or dampening elements can be substituted for, or combined with, the gas springs 186.

EXEMPLARY ASPECTS

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A shelf assembly comprising: a plurality of stanchions, each stanchion having an axis of elongation and comprising a pair of generally parallel legs that define a slot therebetween and respective front edges; a shelf having an underside and an opposed upper surface that defines a plane, wherein the shelf is pivotably coupled to the stanchions about an axis, wherein the shelf is pivotable about and between a stowed position and a use position, wherein the axis extends through the plurality of stanchions at a location above the plane when the shelf is in the use position; and at least one biasing element, wherein each biasing element of the at least one biasing element is disposed at least partially within the slot of a respective stanchion and configured to bias the shelf toward the stowed position.

Aspect 2: The shelf assembly of aspect 1, wherein, when in the stowed position, the plane is generally parallel to the axes of elongation of the stanchions.

Aspect 3: The shelf assembly of aspect 1 or aspect 2, wherein, when in the stowed position, the upper surface of the shelf is disposed against the front edges of the plurality of stanchions.

Aspect 4: The shelf assembly of any one of the preceding aspects, wherein, when the shelf assembly is in the use position, the axis is vertically spaced from the plane by between about 0.5 inches and about 3.0 inches.

Aspect 5: The shelf assembly of any one of the preceding aspects, wherein the shelf has a distal edge, wherein the distal edge defines a flange that extends at an obtuse angle from the plane and above the plane when the shelf is in the use position.

Aspect 6: The shelf assembly of aspect 5, wherein the flange has a first end that intersects the upper surface of the shelf and an opposed second end, wherein the second end comprises a rolled edge.

Aspect 7: The shelf assembly of aspect 6, wherein the rolled edge of the flange has a tear-shaped profile.

Aspect 8: The shelf assembly of any one of the preceding aspects, further comprising a plurality of support arms, wherein each support arm of the plurality of support arms is pivotably attached to a respective stanchion of the plurality of stanchions about the axis, wherein each respective support arm is coupled to the underside of the shelf, and wherein the shelf is pivotably coupled to the plurality of stanchions via the plurality of support arms.

Aspect 9: The assembly of aspect 8, wherein each respective support arm comprises a base wall and a pair of spaced parallel walls that extend perpendicularly the base wall.

Aspect 10: The shelf assembly of aspect 8 or aspect 9, wherein the at least one biasing element is pivotably coupled to, and extending between, a respective stanchion and a respective support arm.

Aspect 11: The shelf assembly of any one of the preceding aspects, wherein the at least one biasing element is a gas spring.

Aspect 12: The shelf assembly of any one of the preceding aspects, further comprising a pair of horizontal rails that extend perpendicularly to the axes of elongation of the stanchions, wherein the horizontal rails attach to opposing first and second ends of each stanchion.

Aspect 13: The shelf assembly of any one of the preceding aspects, wherein the at least one biasing element comprises a first rod eye at a first end of the biasing element and a second rod eye at a second end of the biasing element, wherein the first rod eye is disposed at least partially within the slot of said respective stanchion, and wherein the second rod eye is disposed at least partially between the pair of spaced parallel walls of a respective support arm.

Aspect 14: The shelf assembly of aspect 13, wherein a first pin extends through the first rod eye and the slot of a respective stanchion of the plurality of stanchions, and wherein a second pin extends through the second rod eye and the pair of spaced parallel walls of a respective support arm.

Aspect 15: The shelf assembly of any one of the preceding aspects, wherein the shelf is a first shelf of a plurality of shelves, wherein the plurality of shelves of the shelf assembly further comprises a second shelf that is pivotable about the axis.

Aspect 16: The shelf assembly of aspect 15, wherein the second shelf is independently pivotable with respect to the first shelf Aspect 17: A vehicle comprising a shelf assembly of any one of the preceding aspects.

Although the foregoing invention has been described in some detail by way of illustration and example for purposes of clarity of understanding, certain changes and modifications may be practiced within the scope of the appended claims.

What is claimed is:

1. A shelf assembly comprising:

a plurality of stanchions, each stanchion having an axis of elongation and comprising a pair of parallel or generally parallel legs that define a slot therebetween and respective front edges;

a shelf having an underside and an opposed upper surface that at least partially defines a plane, wherein the shelf is pivotably coupled to the stanchions about an axis, wherein the shelf is pivotable about and between a stowed position and a use position, wherein the axis extends through the plurality of stanchions at a location above the plane when the shelf is in the use position; and at least one biasing element having a first end, a second end, and a spring therebetween, wherein the spring of each biasing element of the at least one biasing element is disposed at least partially within the slot of a respective stanchion and configured to bias the shelf toward the stowed position.

2. The shelf assembly of claim 1, wherein, when in the stowed position, the plane is generally parallel to the axes of elongation of the stanchions.

3. The shelf assembly of claim 1, wherein, when in the stowed position, the upper surface of the shelf is disposed against the front edges of the plurality of stanchions.

4. The shelf assembly of claim 1, wherein, when the shelf assembly is in the use position, the axis is vertically spaced from the plane by between about 0.5 inches and about 3.0 inches.

5. The shelf assembly of claim 1, wherein the shelf has a distal edge, wherein the distal edge defines a flange that extends at an obtuse angle from the plane and above the plane when the shelf is in the use position.

6. The shelf assembly of claim 5, wherein the flange has a first end that intersects the upper surface of the shelf and an opposed second end, wherein the second end comprises a rolled edge.

7. The shelf assembly of claim 6, wherein the rolled edge of the flange has a tear-shaped profile.

8. The shelf assembly of claim 1, further comprising a plurality of support arms, wherein each support arm of the plurality of support arms is pivotably attached to a respective stanchion of the plurality of stanchions about the axis, wherein each respective support arm is coupled to the underside of the shelf, and wherein the shelf is pivotably coupled to the plurality of stanchions via the plurality of support arms.

9. The assembly of claim 8, wherein each respective support arm comprises a base wall and a pair of spaced parallel walls that extend perpendicularly or substantially perpendicularly to the base wall.

10. The shelf assembly of claim 8, wherein the at least one biasing element is pivotably coupled to, and extends between, a respective stanchion and a respective support arm.

11. The shelf assembly of claim 1, wherein the at least one biasing element comprises at least one gas spring.

12. The shelf assembly of claim 1, further comprising a pair of horizontal rails that extend perpendicularly or substantially perpendicularly to the axes of elongation of the stanchions, wherein the horizontal rails attach to opposing first and second ends of each stanchion.

13. The shelf assembly of claim 9, wherein the at least one biasing element further comprises a first rod eye at the first end of the biasing element and a second rod eye at the second end of the biasing element, wherein the first rod eye is disposed at least partially within the slot of the respective stanchion, and wherein the second rod eye is disposed at least partially between the pair of spaced parallel walls of a respective support arm.

14. The shelf assembly of claim 13, wherein a first pin extends through the first rod eye and the slot of a respective stanchion of the plurality of stanchions, and wherein a second pin extends through the second rod eye and the pair of spaced parallel walls of a respective support arm.

15. The shelf assembly of claim 1, wherein the shelf is a first shelf of a plurality of shelves, wherein the plurality of shelves of the shelf assembly further comprises a second shelf that is pivotable about the axis.

16. The shelf assembly of claim 15, wherein the second shelf is independently pivotable with respect to the first shelf.

17. The shelf assembly of claim 5, wherein at least a portion of the flange is positioned vertically above the plurality of stanchions when the shelf is in the stowed configuration.

18. A shelf assembly comprising:

a plurality of stanchions, each stanchion having an axis of elongation and comprising a pair of parallel or generally parallel legs that define a slot therebetween and respective front edges;

a shelf having an underside and an opposed upper surface that at least partially defines a plane; and a plurality of support arms, wherein each support arm of the plurality of support arms includes a proximal end and a distal end, the proximal end defining a hinge portion and a stop, the hinge portion being pivotally attached to a respective stanchion of the plurality of stanchions about an axis, wherein each respective support arm is coupled to the underside of the shelf so that the shelf is pivotably coupled to the plurality of stanchions about the axis via the plurality of support arms, and wherein the shelf is pivotable about and between a stowed position and a use position, wherein the axis extends through the plurality of stanchions at a location above the plane when the shelf is in the use position, and wherein the hinge portion of each support arm is disposed in the slot defined between the parallel legs of the respective stanchion, and each stop engages the front edges of the parallel legs of the respective stanchion when the shelf is in the use position.

19. The shelf assembly of claim 18, further comprising at least one biasing element that is configured to bias the shelf toward the stowed configuration.

20. A vehicle comprising a shelf assembly, the shelf assembly comprising:

a plurality of stanchions, each stanchion having an axis of elongation and comprising a pair of parallel or generally parallel legs that define a slot therebetween and respective front edges;

a shelf having an underside and an opposed upper surface that at least partially defines a plane, wherein the shelf is pivotably coupled to the stanchions about an axis, wherein the shelf is pivotable about and between a stowed position and a use position, wherein the axis extends through the plurality of stanchions at a location above the plane when the shelf is in the use position; and at least one biasing element including a first end, a second end, and a spring disposed therebetween, wherein the spring of each biasing element of the at least one biasing element is disposed at least partially within the slot of a respective stanchion and configured to bias the shelf toward the stowed position.

* * * * *